US007678257B2

(12) United States Patent
Kumagai et al.

(10) Patent No.: US 7,678,257 B2
(45) Date of Patent: Mar. 16, 2010

(54) COPPER ELECTROLYTIC SOLUTION CONTAINING QUATERNARY AMINE COMPOUND POLYMER WITH SPECIFIC SKELETON AND ORGANO-SULFUR COMPOUND AS ADDITIVES, AND ELECTROLYTIC COPPER FOIL MANUFACTURED USING THE SAME

(75) Inventors: Masashi Kumagai, Hitachi (JP); Mikio Hanafusa, Hitachi (JP)

(73) Assignee: Nikko Materials Co., Ltd., Minato-ku, Tokyo (JP)

( * ) Notice: Subject to any disclaimer, the term of this patent is extended or adjusted under 35 U.S.C. 154(b) by 93 days.

(21) Appl. No.: 11/974,462

(22) Filed: Oct. 12, 2007

(65) Prior Publication Data

US 2008/0075972 A1 Mar. 27, 2008

Related U.S. Application Data

(62) Division of application No. 10/486,861, filed as application No. PCT/JP03/11858 on Sep. 17, 2003, now abandoned.

(30) Foreign Application Priority Data

Dec. 25, 2002 (JP) ..... 2002-373719

(51) Int. Cl.
*C25D 1/04* (2006.01)
*C25D 3/38* (2006.01)

(52) U.S. Cl. ..... 205/77; 205/76; 205/296; 205/297; 205/298

(58) Field of Classification Search ..... 205/77, 205/296, 76, 297, 298
See application file for complete search history.

(56) References Cited

U.S. PATENT DOCUMENTS 4,376,685 A * 3/1983 Watson ..... 205/298
5,232,575 A * 8/1993 Dodd ..... 205/238

* cited by examiner

*Primary Examiner*—Edna Wong
(74) *Attorney, Agent, or Firm*—Flynn, Thiel, Boutell & Tanis, P.C.

(57) ABSTRACT

There is obtained a low-profile electrolytic copper foil with a small surface roughness on the side of the rough surface (the opposite side from the lustrous surface) in the manufacture of an electrolytic copper foil using a cathode drum, and more particularly an electrolytic copper foil which allows fine patterning, and is superior in terms of elongation and tensile strength at ordinary temperatures and high temperatures. The present invention provides a copper electrolytic solution, containing as additives an organo-sulfur compound and a quaternary amine compound polymer obtained by homopolymerizing a compound in which the nitrogen of an acrylic type compound having a dialkylamino group is quaternized, or copolymerizing the compound with another compound having an unsaturated bond, and an electrolytic copper foil manufactured using this electrolytic solution.

1 Claim, 3 Drawing Sheets

COPPER ELECTROLYTIC SOLUTION CONTAINING QUATERNARY AMINE COMPOUND POLYMER WITH SPECIFIC SKELETON AND ORGANO-SULFUR COMPOUND AS ADDITIVES, AND ELECTROLYTIC COPPER FOIL MANUFACTURED USING THE SAME

This is a division of Ser. No. 10/486,861, filed Feb. 11, 2004, now abandoned, which was the national stage of International Application No. PCT/JP2003/11858, filed Sep. 17, 2003, which International Application was not published in English.

TECHNICAL FIELD

The present invention relates to a copper electrolytic solution used in the manufacture of an electrolytic copper foil, and more particularly to a copper electrolytic solution used in the manufacture of an electrolytic copper foil that allows fine patterning and is superior in terms of elongation and tensile strength at ordinary and high temperatures.

BACKGROUND ART

Generally, a rotating metal cathode drum with a polished surface, and an insoluble metal anode which is disposed on more or less the lower half of this cathode drum and surrounds the circumference thereof, are used to manufacture electrolytic copper foils. A copper electrolytic solution is caused to flow between the above-mentioned drum and anode, and an electrical potential is applied across these parts, so that copper is electrodeposited on the cathode drum. Then, when the electrodeposited copper has reached a specified thickness, this copper is peeled from the cathode drum, so that a copper foil is continuously manufactured.

The copper foil thus obtained is generally referred to as a raw foil and is subsequently subjected to several surface treatments, and is used in printed wiring boards or the like.

An outline of a conventional copper foil manufacturing apparatus is shown in FIG. 3. In this electrolytic copper foil manufacturing apparatus, a cathode drum 1 is disposed in an electrolysis bath which accommodates an electrolytic solution. This cathode drum 1 rotates in a state in which the drum is partially immersed (i.e., substantially the lower half of the drum is immersed) in the electrolytic solution.

An insoluble anode 2 is disposed so that this anode surrounds the lower half of the cathode drum 1. There is a fixed gap 3 between this cathode drum 1 and anode 2, and an electrolytic solution flows through this gap. Two anode plates are disposed in the apparatus shown in FIG. 3.

In this apparatus shown in FIG. 3, the electrolytic solution is supplied from below, the apparatus is constructed so that this electrolytic solution passes through the gap 3 between the cathode drum 1 and anode 2 and overflows from the upper rim of the anode 2, and so that this electrolytic solution is recirculated. A specified voltage can be maintained between the cathode drum 1 and anode 2 by interposing a rectifier between these parts.

As the cathode drum 1 rotates, the thickness of the copper electrodeposited from the electrolytic solution increases, and when this thickness exceeds a certain thickness, the raw foil 4 is peeled away and continuously taken up. The thickness of the raw foil that is thus manufactured can be adjusted by adjusting the distance between the cathode drum 1 and the anode 2, the flow velocity of the electrolytic solution that is supplied, or the amount of electricity that is supplied.

In the copper foil that is manufactured by such an electrolytic copper foil manufacturing apparatus, the surface that contacts the cathode drum is a mirror surface, however, the surface on the opposite side is a rough surface with projections and indentations. In the case of ordinary electrolysis, the projections and indentations of this rough surface are severe, so that undercutting tends to occur during etching, and the achievement of a fine pattern is difficult.

Recently, meanwhile, as the density of printed wiring boards has increased, the narrowing of the circuit width and the development of multi-layer circuits have led to a demand for copper foils that allow fine patterning. In order to achieve such fine patterning, a copper foil having superior etching characteristics is required.

Furthermore, in regard to the performance values required in copper foils used in printed wiring boards, not only elongation at ordinary temperatures, but also high-temperature elongation characteristics for the purpose of preventing cracking caused by thermal stress, and a high tensile strength for dimensional stability of the printed wiring board, are required.

However, copper foils of the above-mentioned type in which the projections and indentations of the rough surface are severe are completely unsuitable for fine patterning, as was described above. For such reasons, the smoothening of the rough surface to a low profile has been investigated.

It is generally known that such a low profile can be achieved by adding large amounts of glue or thiourea to the electrolytic solution.

However, such additives lead to the problem of an abrupt drop in the elongation at ordinary and high temperatures, thus causing a great drop in the performance of the copper foil as a copper foil for use in printed wiring boards.

DISCLOSURE OF THE INVENTION

It is an object of the present invention to obtain a low-profile electrolytic copper foil with a small surface roughness on the side of the rough surface (the opposite side from the lustrous surface) in the manufacture of an electrolytic copper foil using a cathode drum and, more particularly, to obtain an electrolytic copper foil which allows fine patterning and is superior in terms of elongation and tensile strength at ordinary and high temperatures.

The present inventors discovered that an electrolytic copper foil which allows fine patterning and is superior in terms of elongation and tensile strength at ordinary and high temperatures, can be obtained by adding an optimal amount of an additive that makes it possible to achieve a low profile to the electrolytic solution.

On the basis of this finding, the present inventors discovered that an electrolytic copper foil which allows fine patterning and is superior in terms of elongation and tensile strength at ordinary and high temperatures can be obtained by performing electrolysis using a copper electrolytic solution containing a quaternary amine compound polymer with a specific skeleton and an organo-sulfur compound in an electrolytic copper foil manufacturing method in which a copper foil is continuously manufactured by causing a copper electrolytic solution to flow between a cathode drum and an anode so that copper is electrodeposited on the cathode drum, and peeling the electrodeposited copper foil from the cathode drum. This discovery led to the present invention.

Specifically, the present invention comprises the following constructions:

[1] A copper electrolytic solution, containing as additives an organo-sulfur compound and a quaternary amine compound polymer obtained by homopolymerizing a compound in which nitrogen of an acrylic type compound having a dialkylamino group is quaternized, or copolymerizing the compound with another compound having an unsaturated bond.

[2] The copper electrolytic solution according to [1], wherein the above-mentioned compound obtained by quaternizing nitrogen of an acrylic type compound having a dialkylamino group is expressed by the following general formula (1), (2) or (3).

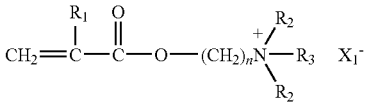

(1)

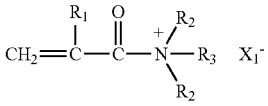

(2)

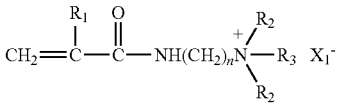

(3)

(In general formulae (1) through (3), $R_1$ indicates hydrogen or an alkyl group with 1 to 5 carbon atoms, each of $R_2$ independently indicates an alkyl group with 1 to 5 carbon atoms, $R_3$ indicates an alkyl group with 1 to 5 carbon atoms, a benzyl group or an allyl group, $X_1^-$ indicates $Cl^-$, $Br^-$ or $CH_3SO_4^-$ and n indicates an integer of 1 to 5.)

[3] The copper electrolytic solution according to [1] wherein the above-mentioned organo-sulfur compound is a compound expressed by the following general formula (4) or (5).

$$X—R^1(S)_n—R^2—Y \quad (4)$$

$$R^4—S—R^3—SO_3Z \quad (5)$$

(In general formulae (4) and (5), $R^1$, $R^2$ and $R^3$ each independently indicate an alkylene group with 1 to 8 carbon atoms, $R^4$ indicates a group selected from the group consisting of hydrogen,

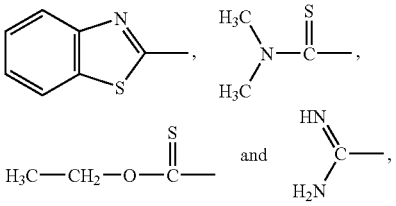

X is selected from the group consisting of hydrogen, a sulfonic acid group, a phosphonic acid group, and an alkali metal salt group or ammonium salt group of sulfonic acid or phosphonic acid, Y is selected from the group consisting of a sulfonic acid group, a phosphonic acid group, and an alkali metal salt group of sulfonic acid or phosphonic acid, Z indicates hydrogen or an alkali metal, and n is 2 or 3.)

[4] An electrolytic copper foil which is manufactured using the copper electrolytic solution according to any of the above-mentioned [1] through [3].

[5] A copper-clad laminate which is formed using the copper electrolytic foil according to the above-mentioned [4].

In the present invention, it is important that the electrolytic solution contain an organo-sulfur compound and a quaternary amine compound polymer obtained by homopolymerizing a compound in which nitrogen of an acrylic type compound that has a dialkylamino group is quaternized, or copolymerizing such a compound with another compound having an unsaturated bond. If only one of these compounds is added, the object of the present invention cannot be achieved.

Examples of acrylic type compounds with a dialkylamino group that can be used in the present invention include acrylic compounds that have a dialkylamino group, methacrylic compounds that have a dialkylamino group and the like. Such compounds include compounds in which an alkyl group is bonded to carbon inside the vinyl group in the compound.

Quaternization of nitrogen of the acrylic type compound having a dialkylamino group is accomplished by adding a quaternizing agent to the acrylic type compound that has a dialkylamino group, and heating and reacting this mixture so that nitrogen is quaternized.

Compounds expressed by the following general formulae (1) through (3) are desirable as such compounds in which the nitrogen of acrylic type compounds having a dialkylamino group is quaternized.

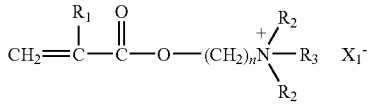

(1)

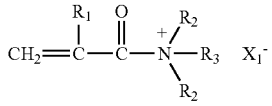

(2)

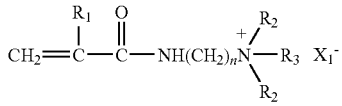

(3)

(In general formulae (1) through (3), $R_1$ indicates hydrogen or an alkyl group with 1 to 5 carbon atoms, each of $R_2$ indicates an alkyl group with 1 to 5 carbon atoms, $R_3$ indicates an alkyl group with 1 to 5 carbon atoms, a benzyl group or an allyl group, $X_1^-$ indicates $Cl^-$, $Br^-$ or $CH_3SO_4^-$, and n indicates an integer of 1 to 5.)

A methyl group or ethyl group is desirable as the alkyl group with 1 to 5 carbon atoms indicated by $R_1$, $R_2$ and $R_3$.

Examples of quaternizing agents that can be used to quaternize the nitrogen include an alkyl halide, benzyl chloride, dimethylsulfuric acid and the like. $R_3$ and $X^-$ in general formulae (1) through (3) are determined by this quaternizing agent.

Furthermore, for example, a compound obtained by quaternizing is N,N-dimethylaminopropylacrylamide with methyl chloride (DMAPAA-Q manufactured by Kohjin K.K.), a compound obtained by quaternizing N,N-dimethylaminoethylacrylate with methyl chloride (DMAEA-Q manufactured by Kohjin K.K.) or the like may be desirably used as the compounds expressed by the above-mentioned general formulae (1) through (3).

The quaternary amine compound polymer that has a specific skeleton is obtained by homopolymerizing these quaternary amine compounds, or copolymerizing the quaternary amine compounds with other compounds that have unsaturated groups.

It is desirable that homopolymerization be accomplished using water as a solvent, and using a radical generating agent such as potassium peroxodisulfate or ammonium peroxodisulfate as a polymerization initiator.

Furthermore, a copolymerizable unsaturated compound is used as the above-mentioned other compound having unsaturated bonds in cases where copolymerization with another compound having unsaturated bonds is performed. Examples of desirable compounds include 2-hydroxyethyl acrylate, 2-hydroxypropyl acrylate, 2-hydroxyethyl methacrylate, dimethylaminoethyl methacrylate and the like.

A weight average molecular weight of 2,000 to 500,000 is desirable as the weight average molecular weight of the quaternary amine compound polymer obtained by homopolymerization or copolymerization.

There may be cases in which the reaction is not sufficiently completed, so that the monomer remains, however, as long as the residual monomer is present at a molar ratio of 40% or less, there is no problem in terms of the characteristics, even if the quaternary amine compound polymer is used as a mixture with this monomer.

Furthermore, it is desirable that the organo-sulfur compound be a compound that has a structural formula indicated by the above-mentioned general formula (4) or (5).

In the above-mentioned general formulae (4) and (5), sodium salts and potassium salts are desirable as the alkali metal salts of sulfonic acid or phosphonic acid indicated by X and Y, and sodium and potassium are also desirable as the alkali metal indicated by Z.

For instance, the following compounds may be cited as examples of organo-sulfur compounds expressed by the above-mentioned general formula (4), and are desirable for use:

$H_2O_3P—(CH_2)_3—S—S—(CH_2)_3—PO_3H_2$ $HO_3S—(CH_2)_4—S—S—(CH_2)_4—SO_3H$ $NaO_3S—(CH_2)_3—S—S—(CH_2)_3-SO_3Na$ $HO_3S—(CH_2)_2—S—S—(CH_2)_2—SO_3H$ $CH_3—S—S—CH_2—SO_3H$ $NaO_3S—(CH_2)_3—S—S—S—(CH_2)_3—SO_3Na$ $(CH_3)_2CH—S—S—(CH_2)_2—SO_3H$

Furthermore, the following compounds may be cited as examples of organo-sulfur compounds expressed by the above-mentioned general formula (5), and are desirable for use:

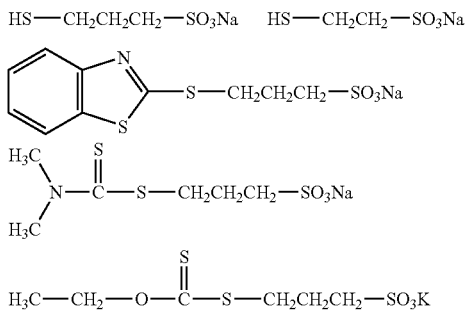

-continued

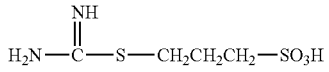

The weight ratio of the quaternary amine compound polymer to the organo-sulfur compound in the copper electrolytic solution is preferably in the range of 1:5 to 5:1, and is even more preferably in the range of 1:2 to 2:1. It is desirable that the concentration of the quaternary amine compound in the copper electrolytic solution be 1 to 50 ppm.

Besides the above-mentioned quaternary amine compound polymer and organo-sulfur compound, universally known additives, e.g., polyether compounds such as polyethylene glycol, polypropylene glycol and the like, as well as polyethyleneimines, phenazine dyes, glue, cellulose and the like, may be added to the copper electrolytic solution.

Furthermore, the copper-clad laminate obtained by laminating the electrolytic copper foil of the present invention is a copper-clad laminate that is superior in terms of elongation and tensile strength at ordinary and high temperatures.

EXPLANATION OF SYMBOLS

1 Cathode drum

2 Anode

3 Gap

4 Raw foil

BEST MODE FOR CARRYING OUT THE INVENTION

The present invention will be described in greater detail below by the embodiments of the present invention.

Figure 1:
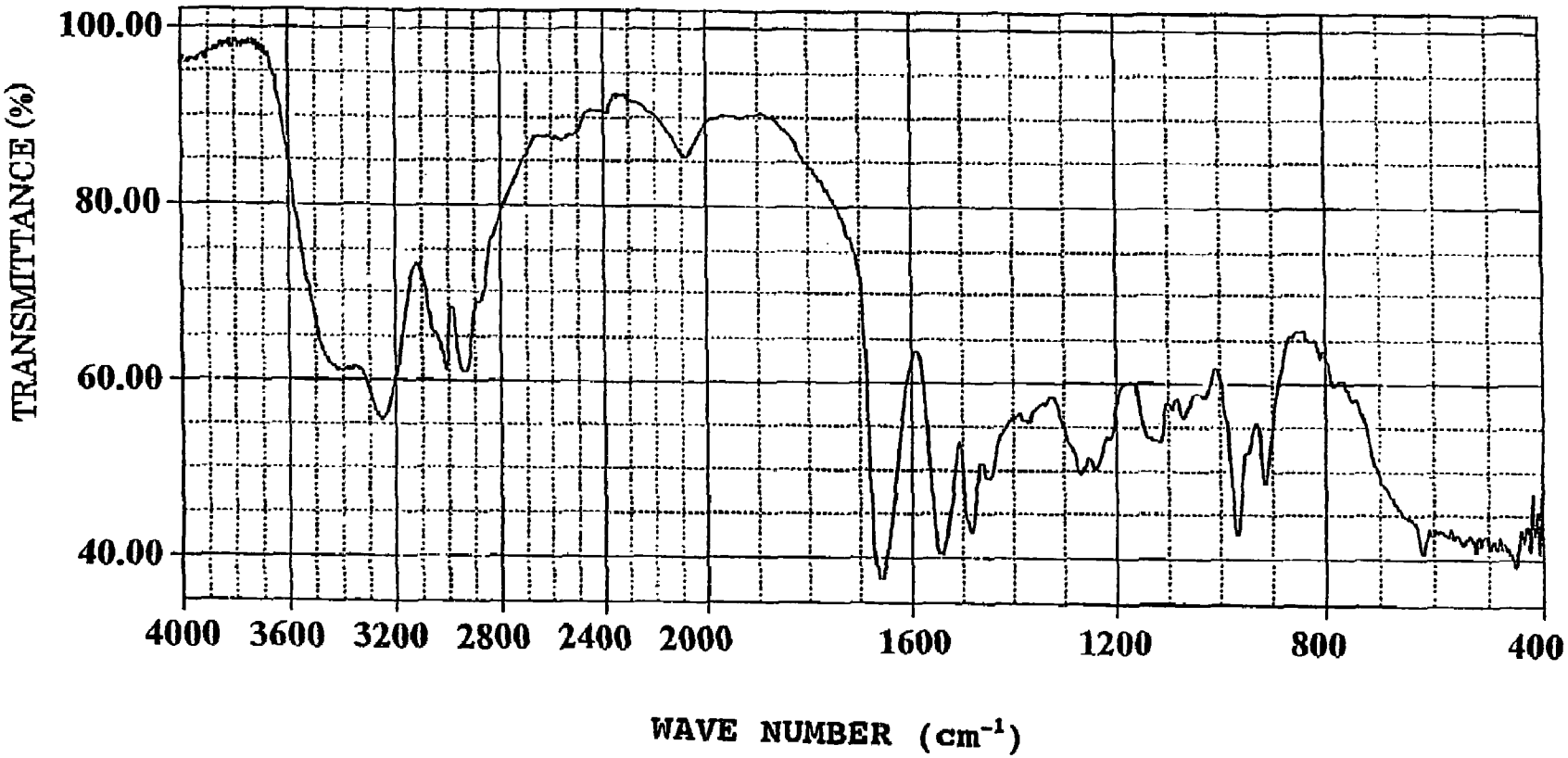
FIG. 1 shows the FT-IR spectrum of a quaternary amine compound polymer obtained as a synthesis example.
Figure 2:
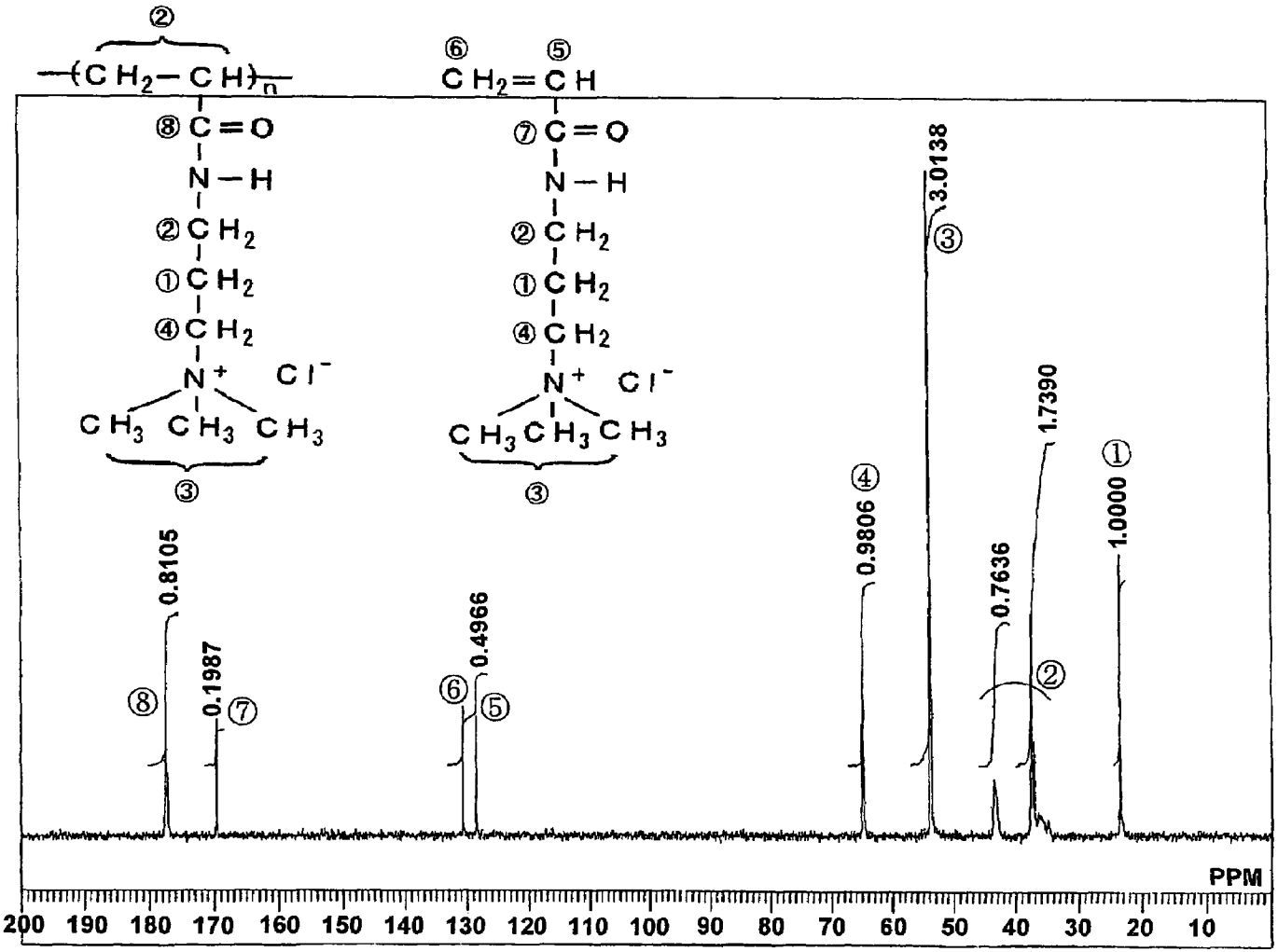
FIG. 2 shows the $^{13}$C-NMR spectrum of a quaternary amine compound polymer obtained as a synthesis example.

Synthesis Example 1 of Quaternary Amine Compound Polymer 50 g of a compound obtained by quaternizing N,N-dimethylaminopropylacrylamide with methyl chloride (DMAPAA-Q manufactured by Kohjin K.K.) was dissolved in 50 g of ion-exchange water. 0.5 g of potassium peroxodisulfate was added to this, and a polymerization reaction was performed for 3 hours at 60° C. in a nitrogen atmosphere. The polymer obtained as a result was identified by FT-IR and $^{13}$C-NMR. The FT-IR and $^{13}$C-NMR spectra of the polymer obtained are shown in FIGS. 1 and 2. The compound obtained was a mixture of a quaternary amine compound polymer expressed by the following chemical formula, and the monomer of this polymer. The monomer content was 20 to 30%.

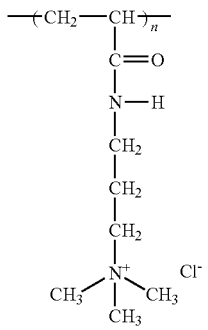

Furthermore, as a result of the measurement of the molecular weight distribution of the obtained quaternary amine compound polymer by means of a hydrogen size exclusion chromatography (SEC) column under the conditions shown below, it was found that the weight-average molecular weight was approximately 80,000. (Residual monomer is not included.)

Conditions

Column:

TSK Guardcolumn PWH+TSK G6000PW+TSK G3000PW (manufactured by Toyo Soda K.K.)

Mobile phase:

0.2M $NaH_2PO_4$+0.2M $Na_2HPO_4$ (pH 6.9)

Flow rate:

1.0 mL/min

Detector:

Refractive index differential refraction type detector

Synthesis Example 2 of Quaternary Amine Compound Polymer

A polymer was obtained as indicated below in the same manner as in Synthesis Example 1.

50 g of a compound obtained by quaternizing N,N-dimethylacrylamide (DMAA manufactured by Kohjin K.K.) with methyl chloride was dissolved in 50 g of ion-exchange water. 0.5 g of potassium peroxodisulfate was added to this, and a polymerization reaction was performed for 3 hours at 60° C. in a nitrogen atmosphere. The compound obtained was a mixture of a quaternary amine compound polymer expressed by the following chemical formula, and the monomer of this polymer. The monomer content was 20 to 30%.

Furthermore, as a result of the measurement of the molecular weight in the same manner as in Synthesis Example 1, it was found that the weight-average molecular weight was approximately 90,000.

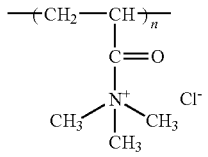

Synthesis Example 3 of Quaternary Amine Compound Polymer

A polymer was obtained as indicated below in the same manner as in Synthesis Example 1.

50 g of a compound obtained by quaternizing N,N-dimethylaminoethyl acrylate with methyl chloride (DMAEA-Q manufactured by Kohjin K.K.) was dissolved in 50 g of ion exchange water. 0.5 g of potassium peroxodisulfate was added to this, and a reaction was performed for 3 hours at 60° C. in a nitrogen atmosphere. The compound obtained was a mixture of a quaternary amine compound polymer expressed by the following chemical formula, and the monomer of this polymer. The monomer content was 20 to 30%.

Furthermore, as a result of the measurement of the molecular weight in the same manner as in Synthesis Example 1, it was found that the weight-average molecular weight was approximately 70,000.

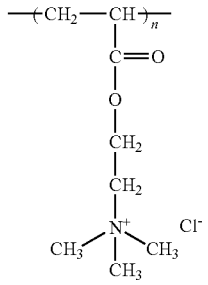

Examples 1 Through 5 and Comparative Examples 1 Through 3

Figure 3:
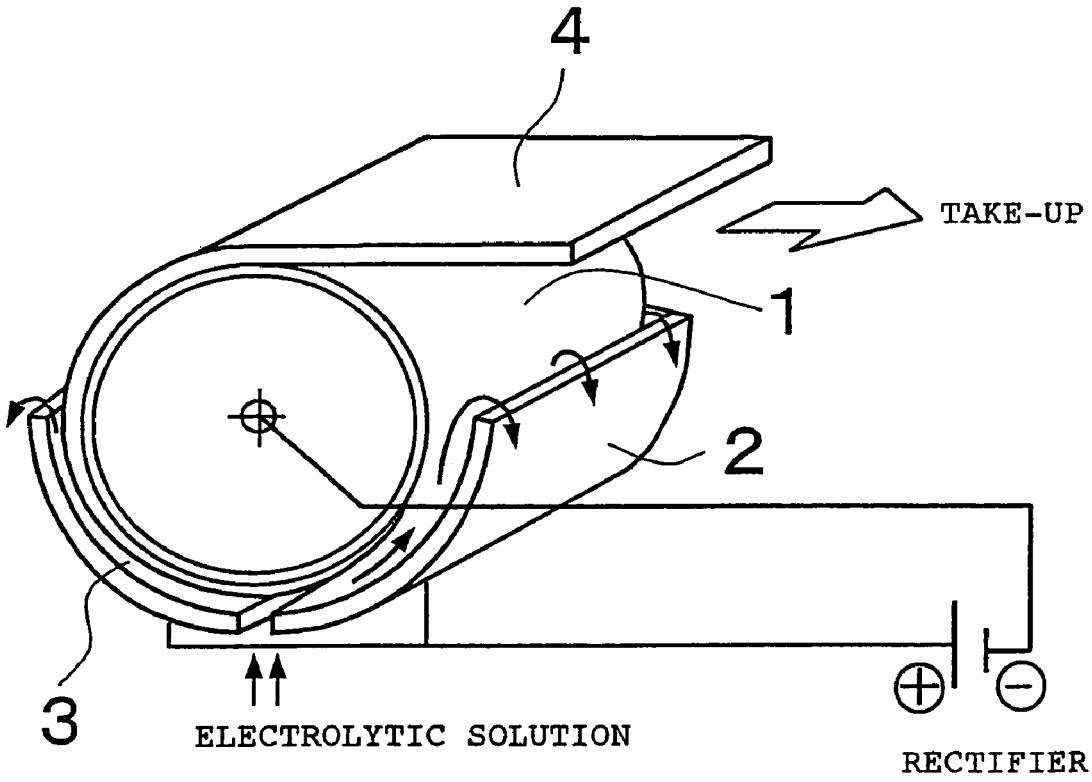
FIG. 3 is a diagram which shows one example of an electrolytic copper foil apparatus.

Electrolytic copper foils with a film thickness of 35 μm were manufactured using an electrolytic copper foil manufacturing apparatus as shown in FIG. 3. The electrolytic solution compositions were as shown below, and as shown in Table 1.

Cu: 90 g/L $H_2SO_4$: 80 g/L

Cl: 60 ppm

Polyethylene glycol (PEG): 20 mg/L or 0 mg/L

Solution temperature: 55 to 57° C.

Additive A1: disodium bis(3-sulfopropyl)disulfide (SPS manufactured by RASCHIG Co.)

Additive A2: sodium 2-mercaptosulfonate (MPS Manufactured by RASCHIG Co.)

Additive B1: quaternary amine compound polymer with specific skeleton obtained in Synthesis Example 1

Additive B2: quaternary amine compound polymer with specific skeleton obtained in Synthesis Example 2

Additive B3: quaternary amine compound polymer with specific skeleton obtained in Synthesis Example 3

The surface roughness Rz (μm) of the electrolytic copper foils obtained was measured for the side of the rough surface, i.e., the opposite side from the lustrous surface in accordance with JIS B 0601, and the ordinary-temperature elongation (%), ordinary-temperature tensile strength (kgf/mm$^2$), high-temperature elongation (%) and high-temperature tensile strength (kgf/mm$^2$) were measured in accordance with IPC-TM650. The results obtained are shown in Table 1.

TABLE 1

| | PEG (mg/L) | Additive A1 (mg/L) | Additive A2 (mg/L) | Additive B1 (mg/L) | Additive B2 (mg/L) | Additive B3 (mg/L) | Rz (μm) | Ordinary-temperature elongation (%) | Ordinary-temperature tensile strength (kgf/mm$^2$) | High-temperature elongation (%) | High-temperature tensile strength (kgf/mm$^2$) |
|---|---|---|---|---|---|---|---|---|---|---|---|
| Example 1 | 20 | 100 | 0 | 50 | 0 | 0 | 0.73 | 11.96 | 34.0 | 14.8 | 20.7 |
| Example 2 | 0 | 100 | 0 | 50 | 0 | 0 | 1.4 | 9.3 | 34.6 | 10.2 | 20.1 |
| Comparative Example 1 | 20 | 0 | 0 | 0 | 0 | 0 | 5.5 | 9.85 | 35.2 | 12.3 | 19.8 |
| Comparative Example 2 | 20 | 0 | 0 | 50 | 0 | 0 | 5.4 | 0.2 | 11.3 | 1.2 | 15.5 |
| Comparative Example 3 | 20 | 100 | 0 | 0 | 0 | 0 | 5.1 | 0.2 | 10.6 | 2.9 | 12.6 |
| Example 3 | 0 | 100 | 0 | 0 | 50 | 0 | 1.3 | 9.2 | 33.2 | 10.5 | 21.1 |
| Example 4 | 0 | 100 | 0 | 0 | 0 | 50 | 1.1 | 9.5 | 35.1 | 10.7 | 20.5 |
| Example 5 | 0 | 0 | 100 | 50 | 0 | 0 | 1.2 | 9.7 | 34.3 | 10.2 | 20.3 |

As is shown in Table 1 above, the surface roughness Rz was in the range of 0.73 to 1.4 μm, the ordinary-temperature elongation was in the range of 9.2 to 11.96%, the ordinary-temperature tensile strength was in the range of 33.2 to 35.1 kgf/mm$^2$, the high-temperature elongation was in the range of 10.2 to 14.8%, and the high-temperature tensile strength was in the range of 20.1 to 21.1 kgf/mm$^2$, in the case of Examples 1 through 5 to which the additives of the present invention (quaternary amine compound polymers with a specific skeleton, and organo-sulfur compounds) were added. Thus, in spite of the fact that a conspicuously low profile could be obtained in the case of these examples, the ordinary-temperature elongation, ordinary-temperature tensile strength, high-temperature elongation and high-temperature tensile strength were all superior characteristics as compared to those of Comparative Example 1 to which no additives were added. In contrast, a low profile could not be achieved in the case of Comparative Example 1 to which no additives were added, or in the case of Comparative Examples 2 and 3, to which only one of the two types of additives was added. Furthermore, in the cases where only one of the two types of additives was added, the ordinary-temperature elongation, ordinary-temperature tensile strength, high-temperature elongation and high-temperature tensile strength actually showed poor results.

INDUSTRIAL APPLICABILITY

It was confirmed from the above results that the copper electrolytic solution of the present invention to which the quaternary amine compound polymer with a specific skeleton and an organo-sulfur compound are added is extremely effective in achieving a low profile in the surface roughness of the electrolytic copper foil that is obtained, that not only the elongation at ordinary temperatures but also the high-temperature elongation characteristics can be effectively maintained, and that a high tensile strength can also similarly be obtained. Furthermore, it is seen that the above-mentioned co-addition is important, and that the above-mentioned characteristics can only be obtained by means of such co-addition.

What is claimed is:

1. A method of manufacturing an electrolytic copper foil comprising the step of electrodepositing a copper foil on a rotating cathode drum from a copper electrolytic solution containing, as additives, an organo-sulfur compound expressed by the following general formula (4) or (5)

$$X—R^1—(S)_n—R^2—Y \quad (4)$$

$$R^4—S—R^3—SO_3Z \quad (5),$$

wherein $R^1$, $R^2$ and $R^3$ each independently are an alkylene group with 1-8 carbon atoms, $R^4$ is a group selected from the group consisting of hydrogen,

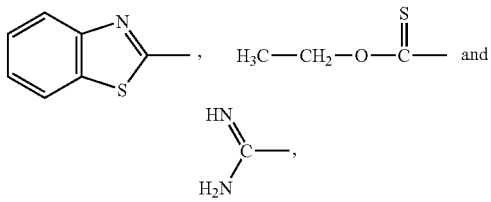

X is selected from the group consisting of hydrogen, a sulfonic acid group, a phosphoric acid group and an alkali metal salt group or ammonium salt group of sulfonic acid or phosphonic acid, Y is selected from the group consisting of a sulfonic acid group, a phosphonic acid group and an alkali metal salt group of sulfonic acid or phosphonic acid, Z is hydrogen or an alkali metal and n is 2 or 3, and a quaternary amine compound polymer obtained by homopolymerizing a compound expressed by the following general formula (2) or (3)

(2)

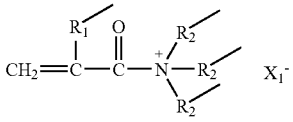

(3)

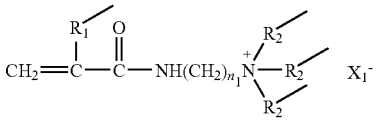

wherein $R_1'$ is hydrogen or an alkyl group with 1-5 carbon atoms, $R_2'$ is an alkyl group with 1-5 carbon atoms, $R_3'$ is an alkyl group with 1-5 carbon atoms, a benzyl group or an allyl group, $X_1$ is Cl, Br or $CH_3SO_4$ and $n_1$ is an integer of 1-5, or copolymerizing the compound of formula (2) or (3) with another compound having an unsaturated bond.

* * * * *